US011584615B2

(12) United States Patent
Hattori

(10) Patent No.: US 11,584,615 B2
(45) Date of Patent: Feb. 21, 2023

(54) ELEVATOR PREVENTIVE MAINTENANCE SYSTEM

(71) Applicant: Mitsubishi Electric Corporation, Chiyoda-ku (JP)

(72) Inventor: Tomohiro Hattori, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 1123 days.

(21) Appl. No.: 16/090,290

(22) PCT Filed: May 24, 2016

(86) PCT No.: PCT/JP2016/065309
§ 371 (c)(1),
(2) Date: Oct. 1, 2018

(87) PCT Pub. No.: WO2017/203602
PCT Pub. Date: Nov. 30, 2017

(65) Prior Publication Data

US 2019/0112151 A1 Apr. 18, 2019

(51) Int. Cl.
*B66B 5/00* (2006.01)
*B66B 5/02* (2006.01)
(Continued)

(52) U.S. Cl.
CPC ..... *B66B 5/0025* (2013.01); *B66B 5/00* (2013.01); *B66B 5/02* (2013.01); *G08B 31/00* (2013.01)

(58) Field of Classification Search
CPC ..... B66B 5/00; B66B 5/0006; B66B 5/0018–0037; B66B 5/0087–021
See application file for complete search history.

(56) References Cited

U.S. PATENT DOCUMENTS 10,920,565 B2 * 2/2021 Hildebrand ..... E21B 7/00

FOREIGN PATENT DOCUMENTS

CN 101362568 A 2/2009
JP 7-37186 A 2/1995
(Continued)

OTHER PUBLICATIONS

Office Action dated Jun. 18, 2019 in Japanese Patent Application No. 2018-518846, 10 pages (with unedited computer generated English translation).

(Continued)

*Primary Examiner* — Christopher Uhlir
(74) *Attorney, Agent, or Firm* — Oblon, McClelland, Maier & Neustadt, L.L.P.

(57) ABSTRACT

An elevator preventive maintenance system capable of helping, when an abnormality of an elevator is predicted to occur, a concerned person needing no countermeasure information to grasp information quickly and easily, and helping a concerned person needing countermeasure information to react to the abnormality quickly and precisely. The system includes: a prediction section configured to predict an abnormality of an elevator to occur, based on abnormality prediction information; a storage section configured to pre-store concerned person information relating to the elevator; a communication section configured to transmit abnormality occurrence prediction information to concerned person in the case the abnormality is predicted to occur.

3 Claims, 3 Drawing Sheets

100: BUILDING
111: CAR EQUIPMENT
112: HALL EQUIPMENT
113: ELEVATOR CONTROL APPARATUS
121: SELF-DIAGNOSIS APPARATUS
122: FIRST STORAGE SECTION
200: INFORMATION CENTER

(51) Int. Cl.
*B66B 1/34* (2006.01)
*G08B 31/00* (2006.01)

(56) References Cited

FOREIGN PATENT DOCUMENTS

| | | | |
|---|---|---|---|
| JP | 2003-20174 | A | 1/2003 |
| JP | 2009-40585 | A | 2/2009 |
| JP | 2009-208932 | A | 9/2009 |
| JP | 5196369 | B2 | 5/2013 |

OTHER PUBLICATIONS

Combined Chinese Office Action and Search Report dated Oct. 21, 2019, in Patent Application No. 201680085820.2, citing document AO therein, 13 pages (with unedited computer generated English translation).
Korean Office Action dated Oct. 24, 2019, in Patent Application No. 10-2018-7033015, 10 pages (with unedited computer generated English translation).
International Search Report dated Aug. 16, 2016 in PCT/JP2016/065309 filed on May 24, 2016.

* cited by examiner

100: BUILDING
111: CAR EQUIPMENT
112: HALL EQUIPMENT
113: ELEVATOR CONTROL APPARATUS
121: SELF-DIAGNOSIS APPARATUS
122: FIRST STORAGE SECTION
200: INFORMATION CENTER

100: EACH OF BUILDINGS
200: INFORMATION CENTER
210: INFORMATION COLLECTION SERVER
220: SECOND STORAGE SECTION
230: MONITOR BOARD
401: FIRST-TYPE CONCERNED PERSON
402: SECOND-TYPE CONCERNED PERSON

FIG. 3

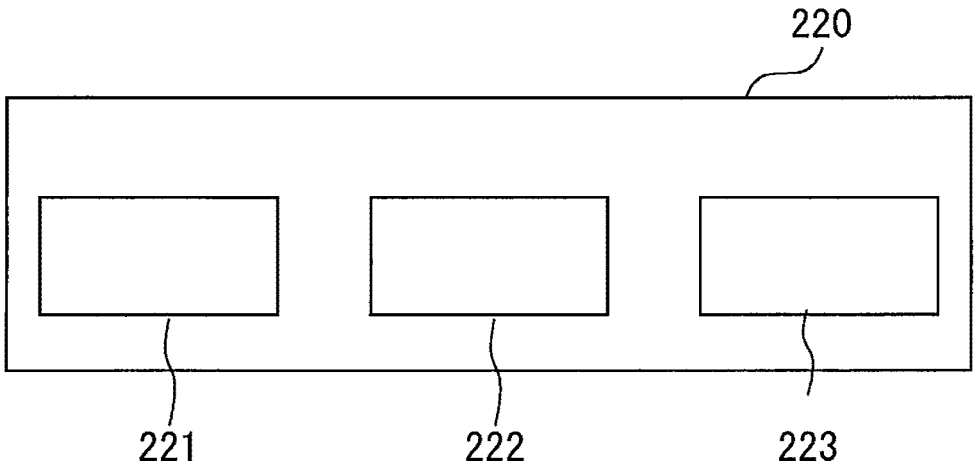

220: SECOND STORAGE SECTION
221: ABNORMALITY PREDICTION INFORMATION STORAGE SECTION
222: CONCERNED PERSON INFORMATION STORAGE SECTION
223: COUNTERMEASURE INFORMATION STORAGE SECTION

FIG. 4

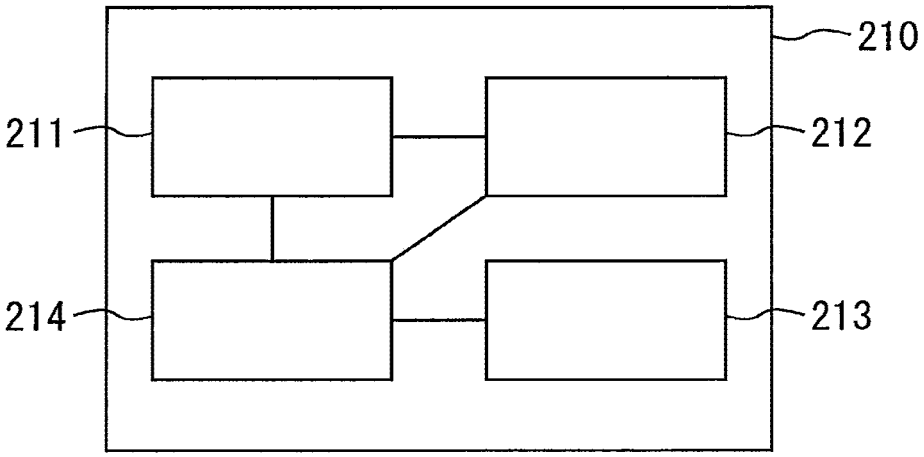

210: INFORMATION COLLECTION SERVER
211: ABNORMALITY OCCURRENCE PREDICTION SECTION
212: COUNTERMEASURE INFORMATION ACQUISITION SECTION
213: NECESSARY INFORMATION DETERMINATION SECTION
214: INFORMATION COMMUNICATION SECTION

ELEVATOR PREVENTIVE MAINTENANCE SYSTEM

TECHNICAL FIELD

The invention relates to an elevator preventive maintenance system.

BACKGROUND ART

As a conventional elevator system, there is known an elevator system in which an elevator control diagnosis section is connected to a business office with a diagnosis center, the elevator control diagnosis section includes a data collection section that collects diagnosis data during the operation of an elevator, a symptom determination section that detects an abnormality based on the diagnosis data, identifies abnormal equipment, and predicts the date of occurrence of a failure, and a unit that transmits symptom data from the symptom determination section to the diagnosis center, the diagnosis center includes a unit that transmits symptom operation instruction information classified according to the content of the symptom data transmitted to the diagnosis center to the business office, and the business office includes an output unit that outputs a symptom operation instruction document based on the symptom operation instruction information transmitted from the diagnosis center (see, e.g., PTL 1).

CITATION LIST

Patent Literature

[PTL 1] Japanese Patent Application Publication No. H07-037186

SUMMARY OF INVENTION

Technical Problem

Thus, the elevator system disclosed in PTL 1 transmits the symptom operation instruction information (countermeasure information against a symptom, i.e., a predicted abnormality) to the business office. However, it is preferable to communicate the symptom (prediction of the abnormality) not only to the business office in charge of maintenance of the elevator but also to a proprietor (owner) of the elevator and the like. At this point, some of the owners of the elevator may not need the symptom operation instruction information and may desire to know only the fact of the symptom. The amount of transmitted information is increased by transmitting the symptom operation instruction information to such owners, and hence there is a possibility that it is not possible to grasp the content of symptom (abnormality prediction) information quickly and easily. This point is not taken into consideration at all in the elevator system disclosed in PTL 1, and hence, in the case where the abnormality of the elevator is predicted to occur, it is not possible to help a person concerned to the elevator (e.g., the proprietor of the elevator or the like) that doesn't need the countermeasure information to grasp the abnormality prediction information quickly and easily.

The invention has been made in order to solve the above problem, and makes it possible to obtain an elevator preventive maintenance system capable of helping, in the case where an abnormality of an elevator is predicted to occur, the concerned person who does not need countermeasure information against the abnormality that is predicted to occur to grasp information quickly and easily, and helping the concerned person who needs the countermeasure information to react to the abnormality quickly and precisely by reliably communicating the countermeasure information to the person concerned.

Solution to Problem

An elevator preventive maintenance system according to the present invention includes: an abnormality prediction information storage section configured to store abnormality prediction information including at least travel information and maintenance information relating to an elevator; an abnormality occurrence prediction section configured to predict occurrence of an abnormality of the elevator, based on the abnormality prediction information stored in the abnormality prediction information storage section; a countermeasure information storage section configured to pre-store countermeasure information corresponding to a content of the abnormality of the elevator; a concerned person information storage section configured to pre-store, for each of persons concerned to the elevator, concerned person information including information on whether or not the concerned person needs the countermeasure information; an information communication section configured to transmit abnormality occurrence prediction information to the concerned person in a case where the abnormality of the elevator is predicted to occur by the abnormality occurrence prediction section; a countermeasure information acquisition section configured to acquire from the countermeasure information storage section the countermeasure information corresponding to the content of the abnormality of the elevator that is predicted to occur by the abnormality occurrence prediction section; and a necessary information determination section configured to determine whether or not the concerned person needs the countermeasure information by referring to the concerned person information stored in the concerned person information storage section when the information communication section transmits the abnormality occurrence prediction information to the concerned person, wherein the information communication section transmits, in a case where the necessary information determination section determines that the concerned person to which the abnormality occurrence prediction information is to be transmitted needs the countermeasure information, the countermeasure information acquired by the countermeasure information acquisition section to the concerned person together with the abnormality occurrence prediction information.

Advantageous Effects of Invention

In the elevator preventive maintenance system according to the invention, there is obtained an effect that, in the case where the abnormality of the elevator is predicted to occur, it is possible to help the concerned person who does not need the countermeasure information against the abnormality that is predicted to occur to grasp the information quickly and easily, and help the concerned person who needs the countermeasure information to react to the abnormality quickly and precisely by reliably communicating the countermeasure information to the concerned person.

BRIEF DESCRIPTION OF THE DRAWINGS

FIG. 3 is a configuration diagram of a second storage section provided in the information center of the elevator preventive maintenance system related to Embodiment 1 of the present invention.

FIG. 4 is a configuration diagram of an information collection server provided in the information center of the elevator preventive maintenance system related to Embodiment 1 of the present invention.

DESCRIPTION OF EMBODIMENT

Figure 1:
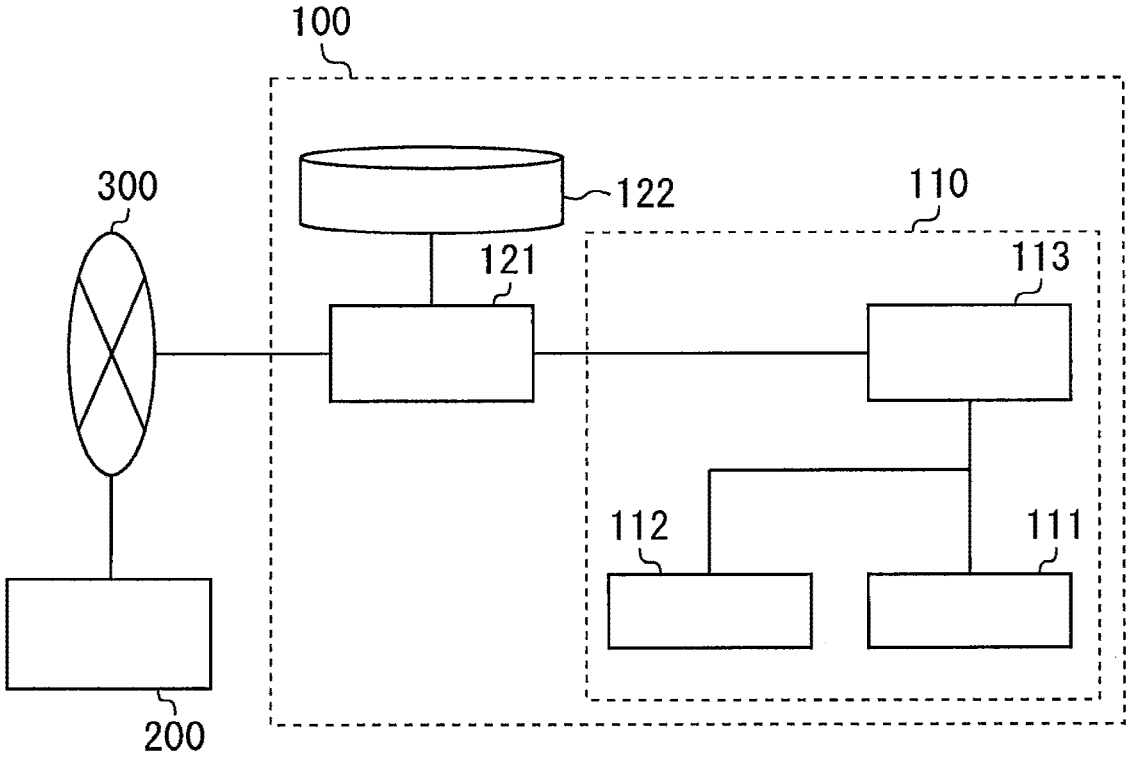
FIG. 1 is a configuration diagram of a building-side of an elevator preventive maintenance system related to Embodiment 1 of the present invention.

Embodiment of the invention will be described with reference to the accompanying drawings. In the drawings, the same or corresponding parts are designated by the same reference numerals, and the repeated description thereof will be appropriately simplified or omitted. Note that the present invention is not limited to the following embodiment, and can be variously modified without departing from the gist of the present invention.

Embodiment 1

Figure 2:
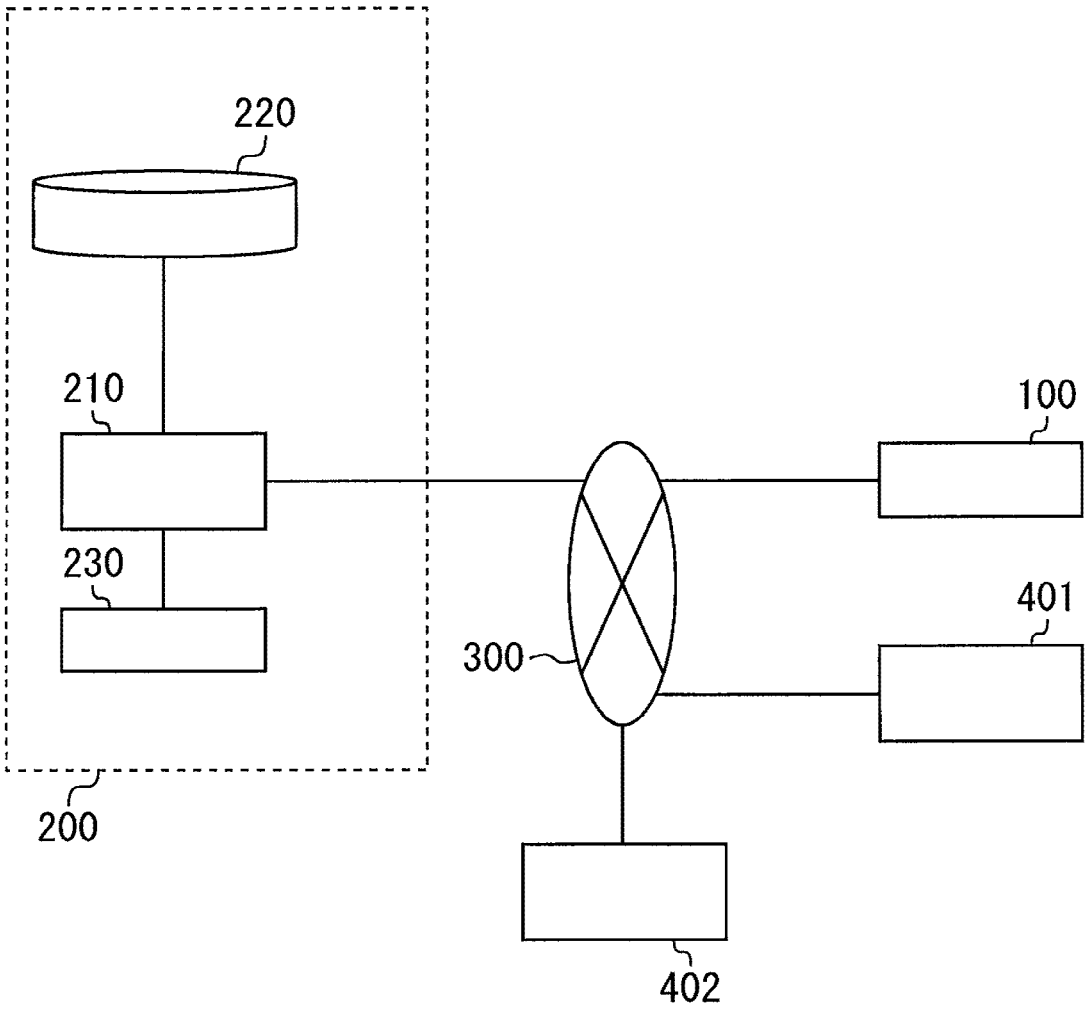
FIG. 2 is a configuration diagram of an information-center-side of the elevator preventive maintenance system related to Embodiment 1 of the present invention.

FIGS. 1 to 4 relate to Embodiment 1 of the invention. FIG. 1 is a configuration diagram of a building-side of an elevator preventive maintenance system, FIG. 2 is a configuration diagram of an information-center-side of the elevator preventive maintenance system, FIG. 3 is a configuration diagram of a second storage section provided in the information center of the elevator preventive maintenance system, and FIG. 4 is a configuration diagram of an information collection server provided in the information center of the elevator preventive maintenance system.

As shown in FIG. 1, the target of preventive maintenance by the elevator preventive maintenance system according to Embodiment 1 of the invention is an elevator 110 installed in a building 100. The elevator 110 includes car equipment 111, hall equipment 112, and an elevator control apparatus 113.

The car equipment 111 is a generic name for a car of the elevator 110, various pieces of equipment for causing the car to travel, and various pieces of equipment provided in the car. Examples of the various pieces of equipment for causing the car to travel include a hoist, a brake apparatus, and a governor. The various pieces of equipment provided in the car include a car control panel and a car door opening/closing mechanism.

The hall equipment 112 is a generic name for various pieces of equipment provided in a hall of the elevator 110. The various pieces of equipment provided in the hall include a hall control panel, a hall lantern, and an information display apparatus.

The elevator control apparatus 113 controls the entire operational actions of the elevator 110 by controlling the operation of each of the car equipment 111 and the hall equipment 112. The elevator control apparatus 113 uses information related to the state of the elevator 110 when the elevator control apparatus 113 controls the operation of the elevator 110. Examples of the information related to the state of the elevator 110 specifically include information on whether the elevator 110 is traveling or stopped, the position of the elevator 110, the operation direction thereof, the situation of call registration, presence or absence of an abnormality of the elevator 110, and the content of the abnormality (in the case where the abnormality is present).

A self-diagnosis apparatus 121 and a first storage section 122 are provided in the building 100 in which the elevator 110 is installed. The self-diagnosis apparatus 121 performs a self-diagnosis of the possibility of a failure of the elevator 110 installed in the building 100. The self-diagnosis apparatus 121 performs the self-diagnosis by using information stored in the first storage section 122.

Travel information and maintenance information relating to the elevator 110 installed in the building 100 are stored in the first storage section 122. The travel information relating to the elevator 110 is information such as the number of travels of the elevator 110, the travel distance thereof, and the travel frequency thereof. The maintenance information relating to the elevator 110 is information such as the history of occurrence of an abnormality such as a failure of the elevator 110, the history of repair of the failure, the result of periodic inspection, and the history of periodic maintenance.

The travel information relating to the elevator 110 can be acquired from the elevator control apparatus 113. It is possible to cause the first storage section 122 to store, among pieces of the maintenance information relating to the elevator 110, e.g., the history of repair of the failure, the result of periodic inspection, and the history of periodic maintenance by inputting them to the system during the execution of the operations of the repair, inspection, and maintenance. In addition, among pieces of the maintenance information relating to the elevator 110, with regard to the history of occurrence of an abnormality such as the failure of the elevator 110, in the case where the elevator control apparatus 113 automatically detects the abnormality occurrence, it is possible to acquire information related to the abnormality from the elevator control apparatus 113.

The building 100 in which the elevator 110 is installed is connected to an information center 200 via a communication network 300 such that the building 100 and the information center 200 can communicate with each other. The communication network 300 is constituted specifically by, e.g., an analog public telephone network and an IP network.

The self-diagnosis apparatus 121 transmits the travel information and the maintenance information relating to the elevator 110 installed in the building 100 that are stored in the first storage section 122 to the information center 200 from the building 100 via the communication network 300. The self-diagnosis apparatus 121 may transmit the result of the self-diagnosis of the elevator 110 installed in the building 100 to the information center 200 from the building 100 as self-diagnosis information via the communication network 300.

The information center 200 is set up at a place different from the building 100 in which the elevator 110 is installed. The information center 200 is set up, e.g., in each area where the building 100 in which the elevator 110 is installed is located. The information center 200 monitors the building 100 in the area controlled by the information center 200. An observer and a maintenance worker of the elevator 110 are permanently stationed in the information center 200. In case of emergency such as occurrence of an abnormality in the elevator 110 of the building 100 in the area controlled by the information center 200, it is possible to dispatch the required staff such as the maintenance worker or the like to the building 100 in which the abnormality has occurred from the information center 200.

Next, the information center 200 will be further described with reference to FIG. 2. In the information center 200, an information collection server 210, a second storage section 220, and a monitor board 230 are provided. The information collection server 210 is provided for collecting information on the elevator 110 installed in the building 100, predicting the occurrence of the abnormality of the elevator 110 based on the collected information, and transmitting abnormality occurrence prediction information and the like to involved parties. The second storage section 220 stores information required for the information collection server 210 to predict the occurrence of the abnormality of the elevator 110, and information required for the information collection server 210 to transmit information. The monitor board 230 is used by the observer in the information center 200 for monitoring the state of the elevator 110 of the building 100 controlled by the information center 200.

The information center 200 is connected to involved parties of the elevator 110 of the building 100 via the communication network 300 such that the information center 200 and the involved parties can communicate with each other. The involved parties of the elevator 110 of the building 100 denote a proprietor (owner) of the elevator 110 of the building 100, an administrator, and a maintenance company that has a contract with the owner or administrator to maintain the elevator 110. The involved parties are classified into two types that are a first-type concerned person 401 and a second-type concerned person 402. The first-type concerned person 401 and the second-type concerned person 402 will be described later.

Next, the second storage section 220 will be described with reference to FIG. 3. The second storage section 220 includes an abnormality prediction information storage section 221, a concerned person information storage section 222, and a countermeasure information storage section 223.

The abnormality prediction information storage section 221 stores abnormality prediction information. The abnormality prediction information includes at least the travel information and the maintenance information relating to the elevator 110. As the travel information and the maintenance information relating to the elevator 110 included in the abnormality prediction information stored by the abnormality prediction information storage section 221, it is possible to use, e.g., the travel information and the maintenance information transmitted from the self-diagnosis apparatus 121 of the building 100 via the communication network 300. The information transmitted from the self-diagnosis apparatus 121 of the building 100 via the communication network 300 is received by an information communication section 214 of the information collection server 210 described later. Subsequently, the information received by the information communication section 214 is stored in the second storage section 220. The abnormality prediction information stored by the abnormality prediction information storage section 221 may further include the self-diagnosis information relating to the elevator 110 transmitted from the self-diagnosis apparatus 121.

The concerned person information storage section 222 pre-stores concerned person information. The concerned person information includes at least information on whether or not the involved part needs countermeasure information described later for each of persons concerned to the elevator 110. Herein, the concerned person who needs the countermeasure information is defined as the first-type concerned person 401. In addition, the concerned person who that does not need the countermeasure information is defined as the second-type concerned person 402. That is, the concerned person information includes at least information on whether each of concerned persons is the first-type concerned person 401 or the second-type concerned person 402. Note that, in the case where there are a plurality of the buildings 100 and a plurality of the elevators 110 managed by the information center 200, the concerned persons are registered in the concerned person information for each building 100 and each elevator 110. In addition, the concerned person information further includes the name of each of concerned person and a destination (mail address) of information.

The countermeasure information storage section 223 pre-stores the countermeasure information. The countermeasure information is information on a countermeasure corresponding to the content of the abnormality of the elevator 110. The countermeasure corresponding to the content of the abnormality denotes an operation (e.g., part replacement or lubrication) required to eliminate the abnormality.

Next, the information collection server 210 will be described with reference to FIG. 4. The information collection server 210 includes an abnormality occurrence prediction section 211, a countermeasure information acquisition section 212, a necessary information determination section 213, and the information communication section 214.

The abnormality occurrence prediction section 211 predicts the occurrence of the abnormality of the elevator 110 based on the abnormality prediction information stored in the abnormality prediction information storage section 221. As described above, the abnormality prediction information includes the travel information and the maintenance information relating to the elevator 110. Consequently, the abnormality occurrence prediction section 211 predicts the occurrence of the abnormality of the elevator 110 by determining a possibility that the abnormality will occur in the elevator 110 during a specific time period preset by using the travel information and the maintenance information relating to the elevator 110, or a possibility that the abnormality is presently occurring. When the abnormality occurrence prediction section 211 predicts the occurrence of the abnormality of the elevator 110, the abnormality occurrence prediction section 211 also determines the content of the abnormality that is predicted to occur in the elevator 110.

At this point, the travel information and the maintenance information relating to the elevator 110 different from the elevator 110 whose possible abnormality occurrence is to be predicted may be used. That is, the abnormality occurrence prediction section 211 may predict the abnormality occurrence by referring to the abnormality that has actually occurred in another elevator 110 and the travel information when the abnormality has occurred, and comparing the travel information when the abnormality has occurred in another elevator 110 with the travel information relating to the elevator 110 whose abnormality occurrence is to be predicted.

In addition, as described above, in the case where the abnormality prediction information includes the self-diagnosis information relating to the elevator 110 by the self-diagnosis apparatus 121, the abnormality occurrence prediction section 211 may predict the occurrence of the abnormality of the elevator 110 by using the self-diagnosis information.

In the case where the abnormality of the elevator 110 is predicted to occur by the abnormality occurrence prediction section 211, the information communication section 214 transmits the abnormality occurrence prediction information to the person concerned to the elevator 110 whose abnormality is predicted to occur. The information communication section 214 acquires information on the person concerned to the elevator 110 whose abnormality is predicted to occur from the concerned person information storage section 222. The abnormality occurrence prediction information transmitted by the information communication section 214 includes information on the content of the abnormality that is predicted to occur in the elevator 110 by the abnormality occurrence prediction section 211.

Herein, when the information communication section 214 transmits the abnormality occurrence prediction information to the concerned person, the necessary information determination section 213 determines whether or not the concerned person needs the countermeasure information. That is, as described above, the involved parties of the elevator 110 include two types of the involved parties that are the first-type concerned person 401 that needs the countermeasure information and the second-type concerned person 402 who does not need the countermeasure information. When the information communication section 214 transmits the abnormality occurrence prediction information to the concerned person, the necessary information determination section 213 checks whether the concerned person serving as the destination of the abnormality occurrence prediction information is the first-type concerned person 401 or the second storage section 220.

Note that the case where the information communication section 214 transmits the abnormality occurrence prediction information to the concerned person is the case where the abnormality of the elevator 110 is predicted to occur by the abnormality occurrence prediction section 211. The concerned person serving as the destination of the abnormality occurrence prediction information is the person concerned to the elevator 110 whose abnormality is predicted to occur by the abnormality occurrence prediction section 211.

The necessary information determination section 213 makes a determination of whether or not the concerned person needs the countermeasure information by referring to the concerned person information stored in the concerned person information storage section 222. Subsequently, in the case where the concerned person serving as the destination of the abnormality occurrence prediction information is the first-type concerned person 401, the necessary information determination section 213 determines that the concerned person needs the countermeasure information. On the other hand, in the case where the concerned person serving as the destination of the abnormality occurrence prediction information is the second-type concerned person 402, the necessary information determination section 213 determines that the concerned person does not need the countermeasure information.

The countermeasure information acquisition section 212 acquires the countermeasure information corresponding to the content of the abnormality of the elevator 110 that is predicted to occur by the abnormality occurrence prediction section 211 from the countermeasure information storage section 223. The acquisition of the countermeasure information by the countermeasure information acquisition section 212 is performed only in the case where the involved parties to which the abnormality occurrence prediction information is to be transmitted by the information communication section 214 include the first-type concerned person 401.

In the case where the necessary information determination section 213 determines that the concerned person to which the abnormality occurrence prediction information is to be transmitted needs the countermeasure information, the information communication section 214 transmits the countermeasure information acquired by the countermeasure information acquisition section 212 to the concerned person together with the abnormality occurrence prediction information. That is, the information communication section 214 transmits the abnormality occurrence prediction information predicted by the abnormality occurrence prediction section 211 and the countermeasure information acquired by the countermeasure information acquisition section 212 to the first-type concerned person 401 via the communication network 300.

On the other hand, the information communication section 214 transmits the abnormality occurrence prediction information predicted by the abnormality occurrence prediction section 211 to the second-type concerned person 402 via the communication network 300. The information communication section 214 doesn't transmit the countermeasure information to the second-type concerned person 402. Note that, as described above, the countermeasure information transmitted to the first-type concerned person 401 by the information communication section 214 corresponds to the abnormality predicted to occur that is included in the abnormality occurrence prediction information.

Note that, as described above, the information collection server 210 and the second storage section 220 are installed in the information center 200. Consequently, the abnormality prediction information storage section 221, the abnormality occurrence prediction section 211, the countermeasure information storage section 223, the concerned person information storage section 222, the information communication section 214, the countermeasure information acquisition section 212, and the necessary information determination section 213 are provided in the information center 200 that is set up at the place different from the building 100 in which the elevator 110 is installed.

In the thus configured elevator preventive maintenance system, the occurrence of the abnormality of the elevator 110 is predicted and, in the case where the abnormality of the elevator 110 is predicted to occur, it is possible to transmit the abnormality occurrence prediction information to the person concerned to the elevator 110. At this point, the involved parties of the elevator 110 include the party that needs the information on the countermeasure against the abnormality that is predicted to occur, and the party that doesn't need the information on the countermeasure against the abnormality that is predicted to occur.

According to the thus configured elevator preventive maintenance system, in the case where the abnormality of the elevator 110 is predicted to occur, the countermeasure information is transmitted to the first-type concerned person 401 together with the abnormality occurrence prediction information, and only the abnormality occurrence prediction information is transmitted to the second-type concerned person 402. Consequently, in the case where the abnormality of the elevator 110 is predicted to occur, it is possible to transmit the countermeasure information to the concerned person (first-type concerned person 401) of the elevator 110 that needs the countermeasure information against the abnormality that is predicted to occur together with the abnormality occurrence prediction information. On the other hand, it is possible to transmit only the abnormality occurrence prediction information to the concerned person (second-type concerned person 402) of the elevator 110 that doesn't need the countermeasure information against the abnormality that is predicted to occur.

Thus, by transmitting the countermeasure information only to the involved part that needs the countermeasure information against the abnormality that is predicted to occur, it is possible to reliably communicate the countermeasure information to the concerned person who actually needs the countermeasure information to help the concerned person to react to the abnormality quickly and precisely. On the other hand, it is possible to communicate only the abnormality occurrence prediction information to the concerned person who does not need the countermeasure information to help the concerned person to grasp the information quickly and easily.

Note that, in the foregoing description, the description has been given of the case where the information collection server 210 and the second storage section 220 are installed in the information center 200. The information center 200 is set up, e.g., in each area where the building 100 in which the elevator 110 is installed is located. The information center 200 monitors the building 100 in the area controlled by the information center 200. At this point, the installation place of each of the information collection server 210 and the second storage section 220 is not limited to the information center 200.

For example, the information collection servers 210 and the second storage sections 220 provided in a plurality of the information centers 200 may be provided collectively at one place by using, e.g., cloud techniques or the like. In this case, the monitor board 230 is installed in each information center 200, and the monitor board 230 of each information center 200 is allowed to access the information collection servers 210 and the second storage sections 220 that are collectively provided at one place. Note that a country in which the building 100 is located may be different from a country in which the information collection server 210 and the second storage section 220 are located.

Thus, in the case where the information collection servers 210 and the second storage sections 220 are collectively provided at one place as well, the abnormality prediction information storage section 221, the abnormality occurrence prediction section 211, the countermeasure information storage section 223, the concerned person information storage section 222, the information communication section 214, the countermeasure information acquisition section 212, and the necessary information determination section 213 are installed at a place different from the building 100 in which the elevator 110 is installed.

In addition, there are cases where a country in which a relay station, line facilities, and nodes (hereinafter referred to as "a relay station and the like") of the communication network 300 are installed is identical to or different from a country in which the information collection server 210, the monitor board 230, and the building 100 are located. Further, the number of countries each having the relay station and the like of the communication network 300 installed therein via which one communication is performed is not limited to one, and there are cases where the communication is performed via the relay stations and the like of a plurality of countries.

Consequently, for example, communication between the monitor board 230 and the building 100 that are located in the same country can be performed occasionally via the relay station and the like of the communication network 300 installed in a country different from the country in which the monitor board 230 and the building 100 are located. At this point, as described above, the number of countries each having the relay station and the like or the nodes and the like installed therein via which the communication is performed can be more than one occasionally.

Furthermore, for example, communication between the building 100 and the information collection server 210 that are located in different countries can be performed occasionally via the relay station and the like of the communication network 300 installed in a third country different from the country (first country) in which the building 100 is located and the country (second country) in which the information collection server 210 is located. At this point, as described above, the number of countries (third countries) each having the relay station and the like installed therein via which the communication is performed can be more than one occasionally.

Thus, the case where the communication among the building 100, the information collection server 210, and the monitor board 230 via the communication network 300 is performed across a plurality of countries is anticipated in the elevator system according to Embodiment 1 of the invention.

INDUSTRIAL APPLICABILITY

The invention can be used in the elevator preventive maintenance system in which the occurrence of the abnormality of the elevator installed in the building is predicted, and the abnormality occurrence prediction information is transmitted to the involved parties of the elevator in the case where the abnormality of the elevator is predicted to occur.

REFERENCE SIGNS LIST

100 Building
110 Elevator
111 Car equipment
112 Hall equipment
113 Elevator control apparatus
121 Self-diagnosis apparatus
122 First storage section
200 Information center
210 Information collection server
211 Abnormality occurrence prediction section
212 Countermeasure information acquisition section
213 Necessary information determination section
214 Information communication section
220 Second storage section
221 Abnormality prediction information storage section
222 Concerned person information storage section
223 Countermeasure information storage section
230 Monitor board
300 Communication network
401 First-type concerned person
402 Second-type concerned person

The invention claimed is:

1. An elevator preventive maintenance system comprising:

an abnormality prediction information storage section implemented by circuitry configured to store abnormality prediction information including at least travel information and maintenance information relating to an elevator;

an abnormality occurrence prediction section implemented by the circuitry configured to predict occurrence of an abnormality of the elevator, based on the abnormality prediction information stored in the abnormality prediction information storage section;

a countermeasure information storage section implemented by the circuitry configured to pre-store countermeasure information corresponding to a content of the abnormality of the elevator;

a concerned person information storage section implemented by the circuitry configured to pre-store, for each concerned person that is concerned to the elevator, concerned person information including information on whether or not the concerned person needs the countermeasure information;

an information communication section implemented by the circuitry configured to transmit abnormality occurrence prediction information to the concerned person in response to the abnormality of the elevator being predicted to occur by the abnormality occurrence prediction section;

a countermeasure information acquisition section implemented by the circuitry configured to acquire from the countermeasure information storage section the countermeasure information corresponding to the content of the abnormality of the elevator that is predicted to occur by the abnormality occurrence prediction section; and a necessary information determination section implemented by the circuitry configured to determine whether or not the concerned person needs the countermeasure information by referring to the concerned person information stored in the concerned person information storage section when the information communication section transmits the abnormality occurrence prediction information to the concerned person, wherein the information communication section transmits, in response to and replace with the phrase—the necessary information determination section determining that the concerned person to which the abnormality occurrence prediction information is to be transmitted needs the countermeasure information, the countermeasure information acquired by the countermeasure information acquisition section to the concerned person together with the abnormality occurrence prediction information, and wherein the abnormality occurrence prediction section predicts an abnormality occurrence of an object elevator whose abnormality occurrence is to be predicted by comparing travel information of the object elevator with travel information of another elevator at a time when an abnormality has actually occurred in the another elevator.

2. The elevator preventive maintenance system according to claim 1, wherein the abnormality prediction information storage section, the abnormality occurrence prediction section, the countermeasure information storage section, the concerned person information storage section, the information communication section, the countermeasure information acquisition section and the necessary information determination section are provided in an information center set up at a place different from a building in which the elevator is installed.

3. The elevator preventive maintenance system according to claim 2, further comprising:

a self-diagnosis apparatus provided in the building, the self-diagnosis apparatus configured to perform a diagnosis of a possibility of a failure of the elevator, based on the travel information and the maintenance information relating to the elevator installed in the building, the self-diagnosis apparatus configured to transmit a diagnosis result to the information center as self-diagnosis information, wherein the abnormality prediction information stored in the abnormality prediction information storage section further includes the self-diagnosis information transmitted from the self-diagnosis apparatus.

* * * * *